US009506006B2

(12) United States Patent
Jones et al.

(10) Patent No.: US 9,506,006 B2
(45) **Date of Patent: *Nov. 29, 2016**

(54) LUBRICATING COMPOSITIONS CONTAINING SALTS OF HYDROCARBYL SUBSTITUTED ACYLATING AGENTS

(75) Inventors: Joanne L. Jones, Nottingham (GB); Dean Thetford, Norden (GB); David J. Moreton, Milford (GB); Matthew D. Gieselman, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 104 days.

This patent is subject to a terminal disclaimer.

(21) Appl. No.: 14/124,894

(22) PCT Filed: Jun. 18, 2012

(86) PCT No.: PCT/US2012/042857

§ 371 (c)(1),
(2), (4) Date: Dec. 9, 2013

(87) PCT Pub. No.: WO2012/177529

PCT Pub. Date: Dec. 27, 2012

(65) Prior Publication Data

US 2014/0107002 A1 Apr. 17, 2014

Related U.S. Application Data

(60) Provisional application No. 61/499,248, filed on Jun. 21, 2011.

(51) Int. Cl.

| | |
|---|---|
| ***C10M 141/06*** | (2006.01) |
| ***C10M 133/54*** | (2006.01) |
| ***C10M 133/56*** | (2006.01) |

(52) U.S. Cl.

CPC ..... *C10M 141/06* (2013.01); *C10M 133/54* (2013.01); *C10M 133/56* (2013.01); *C10M 2215/26* (2013.01); *C10M 2215/28* (2013.01); *C10M 2219/044* (2013.01);

(Continued)

(58) Field of Classification Search

CPC ..... C10M 2215/02; C10M 2215/086
USPC ..... 508/287–295
See application file for complete search history.

(56) References Cited

U.S. PATENT DOCUMENTS

| | | | |
|---|---|---|---|
| 3,778,371 | A | 12/1973 | Malec et al. |
| 4,056,531 | A | 11/1977 | Malec et al. |
| 4,171,959 | A | 10/1979 | Vartanian et al. |

(Continued)

FOREIGN PATENT DOCUMENTS

| | | | |
|---|---|---|---|
| WO | 2010132259 | A1 | 11/2010 |

*Primary Examiner* — Ellen McAvoy
(74) *Attorney, Agent, or Firm* — Christopher P. Demas; Teresan W. Gilbert

(57) ABSTRACT

The present invention provides a composition and a concentrate, comprising: (a) a major amount of an oil of lubricating viscosity, (b) a quaternary ammonium salt of a hydrocarbyl-substituted acylating agent condensation product, and (c) an optional amount of a succinimide dispersant different from (b), and a use of the composition or concentrate for lubricating an engine. In a further embodiment, the invention provides the use of a quaternary ammonium salt of a hydrocarbyl-substituted acylating agent condensation product as a dispersant in a lubricating composition, and as a synergistic dispersant combination with a different succinimide dispersant.

7 Claims, 3 Drawing Sheets

(52) U.S. Cl.
CPC ..... *C10N 2230/04* (2013.01); *C10N 2240/10* (2013.01); *C10N 2270/00* (2013.01)

(56) References Cited

U.S. PATENT DOCUMENTS

| | | | | |
|---|---|---|---|---|
| 4,248,719 | A | 2/1981 | Chafetz et al. | |
| 4,253,980 | A | 3/1981 | Hammond et al. | |
| 4,306,070 | A | 12/1981 | Hammond et al. | |
| 4,326,973 | A | 4/1982 | Hammond et al. | |
| 4,338,206 | A | 7/1982 | Hammond et al. | |
| 5,254,138 | A | 10/1993 | Kurck et al. | |
| 7,947,093 | B2 | 5/2011 | Barton et al. | |
| 7,951,211 | B2 * | 5/2011 | Barton et al. | 44/422 |
| 8,153,570 | B2 * | 4/2012 | Barton et al. | 508/547 |
| 2008/0113890 | A1 * | 5/2008 | Moreton et al. | 508/547 |
| 2008/0307698 | A1 | 12/2008 | Barton et al. | |
| 2011/0143981 | A1 | 6/2011 | Barton et al. | |
| 2012/0247514 | A1 * | 10/2012 | Butke et al. | 134/22.11 |

* cited by examiner

LUBRICATING COMPOSITIONS CONTAINING SALTS OF HYDROCARBYL SUBSTITUTED ACYLATING AGENTS

BACKGROUND OF THE INVENTION

The present invention relates to lubricating compositions containing dispersants.

Modern crankcase lubricants function to prevent carbonaceous and sludge deposits. Within these crankcases, detergents and dispersants are typically employed to keep pistons and other parts free and cleat of deposits. There are several industry standard tests used to evaluate a lubricant's ability to handle deposits and sludge including the Sequence VG, Sequence IIIG, TDi, Cat 1N, OM501 LA and others.

U.S. Pat. No. 4,171,959 discloses a motor fuel composition containing quaternary ammonium salts of a succinimide. The quaternary ammonium salt has a counterion of a halide, a sulphonate or a carboxylate.

U.S. Pat. No. 4,338,206 and U.S. Pat. No. 4,326,973 discloses fuel compositions containing a quaternary ammonium salt of a succinimide, wherein the ammonium ion is heterocyclic aromatic (pyridinium ion).

U.S. Pat. No. 5,254,138 discloses a fuel composition containing a reaction product of a polyalkyl succinic anhydride with a polyamino hydroxyalkyl quaternary ammonium salt.

U.S. Pat. No. 4,056,531 discloses a lubricating oil or fuel containing a quaternary ammonium salt of a hydrocarbon with a Mw of 350 to 3000 bonded to triethylenediamine. The quaternary ammonium salt counterion is selected from halides, phosphates, alkylphosphates, dialkylphosphates, borates, alkylborates, nitrites, nitrates, carbonates, bicarbonates, alkanoates, and O,O-dialkyldithiophosphates.

U.S. Pat. No. 4,248,719 discloses a fuel or lubricating oil containing a quaternary ammonium salt of a succinimide with a monocarboxylic acid ester.

U.S. Pat. No. 4,253,980 and U.S. Pat. No. 4,306,070 disclose a fuel composition containing a quaternary ammonium salt of an ester-lactone.

U.S. Pat. No. 3,778,371 discloses a lubricating oil or fuel containing a quaternary ammonium salt of a hydrocarbon with a Mw of 350 to 3000 and the remaining groups to the quaternary nitrogen are selected from the group of C1 to C20 alkyl, C2 to C8 hydroxyalkyl, C2 to C20 alkenyl or cyclic groups.

U.S. Pat. Nos. 7,951,211 and 7,947,093 disclose quaternary ammonium salt detergents for use in fuel compositions to reduce intake valve deposits.

Recent industry engine oil upgrades place increasing demands on the lubricant with regards to deposit performance. For instance, the new ILSAC GF-5 specification requires a 4.0 piston merit rating in the Sequence IIIG (vs. 3.5 for GF-4). Increased deposit requirements call for new chemistry and formulation strategies.

SUMMARY OF INVENTION

Figure 1:
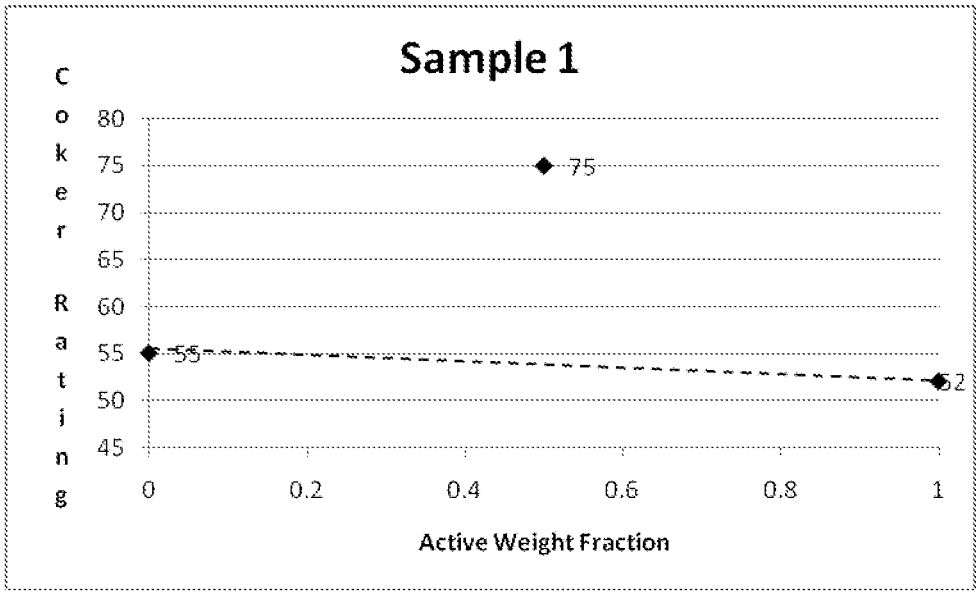
FIG. 1 provides a graphical view of the coker panel results for Sample 1 from Examples 1, 2 and 3.

It has been found by the present inventors that quaternary ammonium salts of a hydrocarbyl-substituted acylating agent condensation product improve deposit performance, especially in the coker panel test. These salts can typically be the product of an amino alcohol, such as dimethylaminopropanol, or a diamine, such as dimethylaminopropylamine (DMAPA), reacted with polyisobutylene succinic anhydride (PIBSA). The resulting ester or imide can then be converted, for example, to an ester/ammonium salt or imide/ammonium salt, for example, with propylene oxide or propylene oxide in the presence of a suitable acid. When included in a typical additive package, the subsequent lubricant can be effective at decreasing deposits.

Thus, the present invention provides a composition, comprising:

(a) a major amount of an oil of lubricating viscosity; and, (b) a quaternary ammonium salt of a hydrocarbyl-substituted acylating agent condensation product.

In another embodiment, the invention further provides a composition as described above with the addition of a succinimide dispersant different from (b).

The present invention further provides a method for lubricating an engine, comprising supplying thereto either of the above compositions.

The present invention further provides a concentrate suitable for dilution with oil of lubricating viscosity to prepare a lubricant, comprising (a) a concentrate-forming amount of an oil of lubricating viscosity; (b) a quaternary ammonium salt of a hydrocarbyl-substituted acylating agent condensation product, and (c) an optional amount of a succinimide dispersant different from (b).

In a still further embodiment, the invention provides the use of a quaternary ammonium salt of a hydrocarbyl-substituted acylating agent condensation product as a dispersant in a lubricating composition, and as a synergistic dispersant combination with a different succinimide dispersant.

DETAILED DESCRIPTION OF THE INVENTION

Various preferred features and embodiments will be described below by way of non-limiting illustration.

One component of the present invention is an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition. For concentrates, the oil of lubricating viscosity may be present at lower concentration or in a minor amount, for example, from 10 to 50% by weight, and in one embodiment 10 to 30% by weight.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans. The synthetic oils may be produced by Fischer-Tropsch reactions and typically may comprise hydroisomerized Fischer-Tropsch hydrocarbons and/or waxes, or hydroisomerized slack waxes.

Unrefined, refined and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group II, Group III, Group IV, or Group V oil, including a synthetic oil, or mixtures thereof. These are classifications established by the API Base Oil Interchangeability Guidelines. Both Group II and Group III oils contain ≤0.03 percent sulfur and ≥90 percent saturates. Group II oils have a viscosity index of 80 to 120, and Group III oils have a viscosity index ≥120. Polyalphaolefins are categorized as Group IV. Group V is encompasses "all others" (except for Group I, which contains >0.03% S and/or <90% saturates and has a viscosity index of 80 to 120).

In one embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present invention can encompass oils of a single viscosity range or a mixture of high viscosity and low viscosity range oils. In one embodiment, the oil exhibits a 100° C. kinematic viscosity of 1 or 2 to 8 or 10 $mm^2/sec$ (cSt). The overall lubricant composition may be formulated using oil and other components such that the viscosity at 100° C. is 1 or 1.5 to 10 or 15 or 20 $mm^2/sec$ and the Brookfield viscosity (ASTM-D-2983) at −40° C. is less than 0.02 or 0.15 mPa-s (20 cP or 15 cP), such as less than 0.1 mPa-s, even 0.05 or less.

Component (b) is a quaternary ammonium salt of a hydrocarbyl-substituted acylating agent condensation product. The quaternary ammonium salt of a hydrocarbyl-substituted acylating agent condensation product may be present in a lubricating composition between 0.1 wt % and 20 wt % on an active basis (i.e., diluent oil free), or 0.1 wt % to 15 wt %, or 0.1 wt % to 10 wt %, or 1 wt % to 6 wt %, or 1 to 3 wt % of the lubricating composition, on an active basis. The quaternary ammonium salt of a hydrocarbyl-substituted acylating agent condensation product comprises the reaction product of: (i) a hydrocarbyl-substituted acylating agent and a compound having an oxygen or nitrogen atom capable of condensing with said acylating agent, and further having a tertiary amino group; and (ii) a quaternizing agent suitable for converting the tertiary amino group to a quaternary nitrogen, wherein the quaternizing agent is selected from the group consisting of dialkyl sulfates, benzyl halides, organic carbonates such as hydro carbyl substituted carbonates, hydrocarbyl epoxides, mixtures of hydrocarbyl epoxides and acids, or mixtures thereof.

The Hydrocarbyl-Substituted Acylating Agent

A hydrocarbyl substituted acylating agent according to the present invention can be the reaction product of a polyolefin substituted with a monounsaturated carboxylic acid reactant such as (i) α,β-monounsaturated $C_4$ to $C_{10}$ dicarboxylic acid such as fumaric acid, itaconic acid, maleic acid; (ii) derivatives of (i) such as anhydrides or $C_1$ to $C_5$ alcohol derived mono- or di-esters of (i); (iii) α,β-monounsaturated $C_3$ to $C_{10}$ monocarboxylic acid such as acrylic acid and methacrylic acid; or (iv) derivatives of (iii) such as $C_1$ to $C_5$ alcohol derived esters of (iii) with any compound containing an olefinic bond represented by the general formula:

$$(R^1)(R^2)C{=}C(R^6)(CH(R^7)(R^8)) \quad (I)$$

wherein each of $R^1$ and $R^2$ is, independently, hydrogen or a hydrocarbon based group. Each of $R^6$, $R^7$ and $R^8$ is, independently, hydrogen or a hydrocarbon based group; preferably at least one is a hydrocarbon based group containing at least 20 carbon atoms.

Olefin polymers for reaction with the monounsaturated carboxylic acids can include polymers comprising a major molar amount of $C_2$ to $C_{20}$, e.g. $C_2$ to $C_5$ monoolefin. Such olefins include ethylene, propylene, butylene, isobutylene, pentene, octene-1, or styrene. The polymers can be homopolymers such as polyisobutylene, as well as copolymers of two or more of such olefins such as copolymers of; ethylene and propylene; butylene and isobutylene; propylene and isobutylene. Other copolymers include those in which a minor molar amount of the copolymer monomers e.g., 1 to 10 mole % is a $C_4$ to $C_{18}$ diolefin, e.g., a copolymer of isobutylene and butadiene; or a copolymer of ethylene, propylene and 1,4-hexadiene.

In one embodiment, at least one R of formula (I) is derived from polybutene, that is, polymers of $C_4$ olefins, including 1-butene, 2-butene and isobutylene. $C_4$ polymers can include polyisobutylene. In another embodiment, at least one R of formula (I) is derived from ethylene-alpha olefin polymers, including ethylene-propylene-diene polymers. Ethylene-alpha olefin copolymers and ethylene-lower olefin-diene terpolymers are described in numerous patent documents, including European patent publication EP 0 279 863 and the following U.S. Pat. Nos. 3,598,738; 4,026,809; 4,032,700; 4,137,185; 4,156,061; 4,320,019; 4,357,250; 4,658,078; 4,668,834; 4,937,299; 5,324,800 each of which are incorporated herein by reference for relevant disclosures of these ethylene based polymers.

In another embodiment, the olefinic bonds of formula (I) are predominantly vinylidene groups, represented by the following formulas:

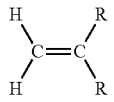

(II)

wherein R is a hydrocarbyl group

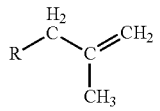

(III)

wherein R is a hydrocarbyl group.

In one embodiment, the vinylidene content of formula (I) can comprise at least about 30 mole % vinylidene groups, at least about 50 mole % vinylidene groups, or at least about 70 mole % vinylidene groups. Such material and methods for preparing them are described in U.S. Pat. Nos. 5,071,919; 5,137,978; 5,137,980; 5,286,823, 5,408,018, 6,562,913, 6,683,138, 7,037,999 and U.S. Publication Nos. 20040176552A1, 20050137363 and 20060079652A1, which are expressly incorporated herein by reference, such products are commercially available by BASF, under the tradename GLISSOPAL® and by Texas PetroChemical LP, under the tradename TPC 1105™ and TPC 595™.

Methods of making hydrocarbyl substituted acylating agents from the reaction of the monounsaturated carboxylic acid reactant and the compound of formula (I) are well know in the art and disclosed in the following patents: U.S. Pat. Nos. 3,361,673 and 3,401,118 to cause a thermal "ene" reaction to take place; U.S. Pat. Nos. 3,087,436; 3,172,892; 3,272,746, 3,215,707; 3,231,587; 3,912,764; 4,110,349; 4,234,435; 6,077,909; 6,165,235 and are hereby incorporated by reference.

In another embodiment, the hydrocarbyl substituted acylating agent can be made from the reaction of at least one carboxylic reactant represented by the following formulas:

$$(R^3C(O)(R^4)_nC(O))R^5 \quad \text{and} \tag{IV}$$

$$R^3-\underset{\underset{OH}{|}}{\overset{\overset{OR^9}{|}}{C}}-(R^4)_n-C(O)OR^5 \tag{V}$$

wherein each of $R^3$, $R^5$ and $R^9$ is independently H or a hydrocarbyl group, $R^4$ is a divalent hydrocarbylene group and n is 0 or 1 with any compound containing an olefin bond as represented by formula (I). Compounds and the processes for making these compounds are disclosed in U.S. Pat. Nos. 5,739,356; 5,777,142; 5,786,490; 5,856,524; 6,020,500; and 6,114,547.

In yet another embodiment, the hydrocarbyl substituted acylating agent can be made from the reaction of any compound represented by formula (I) with (IV) or (V), and can be carried out in the presence of at least one aldehyde or ketone. Suitable aldehydes include formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful, although monoaldehydes are generally preferred. In one embodiment, aldehyde is formaldehyde, which can be supplied as the aqueous solution often referred to as formalin, but is more often used in the polymeric form as paraformaldehyde, which is a reactive equivalent of, or a source of, formaldehyde. Other reactive equivalents include hydrates or cyclic trimers. Suitable ketones include acetone, methyl ethyl ketone, and other ketones. Preferably, one of the two hydrocarbyl groups is methyl. Mixtures of two or more aldehydes and/or ketones are also useful. Compounds and the processes for making these compounds are disclosed in U.S. Pat. Nos. 5,840,920; 6,147,036; and 6,207,839.

In another embodiment, the hydrocarbyl substituted acylating agent can include, methylene bis-phenol alkanoic acid compounds, the condensation product of (i) aromatic compound of the formula:

$$R_m-Ar-Z_c \tag{VI}$$

wherein R is independently a hydrocarbyl group, Ar is an aromatic group containing from 5 to about 30 carbon atoms and from 0 to 3 optional substituents such as amino, hydroxy- or alkyl-polyoxyalkyl, nitro, aminoalkyl, carboxy or combinations of two or more of said optional substituents, Z is independently OH, lower alkoxy, $(OR^{10})_bOR^{11}$, or oxygen wherein each $R^{10}$ is independently a divalent hydrocarbyl group, $R^{11}$ is H or hydrocarbyl and b is a number ranging from 1 to about 30. c is a number ranging from 1 to about 3 and m is 0 or an integer from 1 up to about 6 with the proviso that m does not exceed the number of valences of the corresponding Ar available for substitution and (ii) at least on carboxylic reactant such as the compounds of formula (IV) and (V) described above. In one embodiment, at least one hydrocarbyl group on the aromatic moiety is derived from polybutene. In one embodiment, the source of hydrocarbyl groups are above described polybutenes obtained by polymerization of isobutylene in the presence of a Lewis acid catalyst such as aluminum trichloride or boron trifluoride.

Compounds and the processes for making these compounds are disclosed in U.S. Pat. Nos. 3,954,808; 5,336,278; 5,458,793; 5,620,949; 5,827,805; and 6,001,781.

In another embodiment, the reaction of (i) with (ii), optionally in the presence of an acidic catalyst such as organic sulfonic acids, heteropolyacids, and mineral acids, can be carried out in the presence of at least one aldehyde or ketone. The aldehyde or ketone reactant employed in this embodiment is the same as those described above. The ratio of the hydroxyaromatic compound:carboxylic reactant:aldehyde or ketone can be 2:(0.1 to 1.5):(1.9 to 0.5). In one embodiment, the ratio is 2:(0.8 to 1.1):(1.2 to 0.9). The amounts of the materials fed to the reaction mixture will normally approximate these ratios, although corrections may need to be made to compensate for greater or lesser reactivity of one component or another, in order to arrive at a reaction product with the desired ratio of monomers. Such corrections will be apparent to the person skilled in the art. While the three reactants can be condensed simultaneously to form the product, it is also possible to conduct the reaction sequentially, whereby the hydroxyaromatic is reacted first with either the carboxylic reactant and thereafter with the aldehyde or ketone, or vice versa. Compounds and the processes for making these compounds are disclosed in U.S. Pat. No. 5,620,949.

Other methods of making the hydrocarbyl-substituted acylating agents can be found in the following reference, U.S. Pat. Nos. 5,912,213; 5,851,966; and 5,885,944 which are hereby incorporated by reference.

Compound Having a Nitrogen or Oxygen Atom

The composition of the present invention contains a compound having an oxygen or nitrogen atom capable of condensing with the acylating agent and further having a tertiary amino group.

In one embodiment, the compound having an oxygen or nitrogen atom capable of condensing with the acylating agent and further having a tertiary amino group can be represented by the following formulas:

$$\begin{array}{ccccc} H & & & & R^3 \\ & \diagdown & & \diagup & \\ & N & -X- & N & \\ & \diagup & & \diagdown & \\ R^2 & & & & R^4 \end{array} \tag{VII}$$

wherein X is an alkylene group containing about 1 to about 4 carbon atoms; $R^2$ can be hydrogen or a hydrocarbyl group, and $R^3$ and $R^4$ can be hydrocarbyl groups.

(VIII)

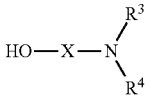

wherein X is an alkylene group containing about 1 to about 4 carbon atoms; $R^3$ and $R^4$ are hydrocarbyl groups.

Examples of the nitrogen or oxygen contain compounds capable of condensing with the acylating agent and further having a tertiary amino group can include but are not limited to: 1-aminopiperidine, 1-(2-aminoethyl)piperidine, 1-(3-aminopropyl)-2-pipecoline, 1-methyl-(4-methylamino)piperidine, 1-amino-2,6-dimethylpiperidine, 4-(1-pyrrolidinyl) piperidine, 1-(2-aminoethyl)pyrrolidine, 2-(2-amino ethyl)-1-methylpyrrolidine, N,N-diethylethylenediamine, N,N-dimethylethylenediamine, N,N-dibutylethylenediamine, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropyl-amine, 3-(dimethylamino)-2,2-dimethylpropan-1-ol, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), or combinations thereof. In some embodiments the amine used is 3-dimethylaminopropylamine, 3-diethylamino-propylamine, 1-(2-aminoethyl)pyrrolidine, N,N-dimethylethylenediamine, or combinations thereof.

Suitable compounds further include aminoalkyl substituted heterocyclic compounds such as 1-(3-aminopropyl) imidazole and 4-(3-aminopropyl)morpholine, 1-(2-aminoethyl)piperidine, 3,3-diamino-N-methyldipropylamine, 3'3-aminobis(N,N-dimethylpropylamine). These have been mentioned in previous list.

Still further nitrogen or oxygen containing compounds capable of condensing with the acylating agent which also have a tertiary amino group include: alkanolamines, including but not limited to triethanolamine, N,N-dimethylaminopropanol, N,N-diethylaminopropanol, N,N-diethylaminobutanol, N,N,N-tris(hydroxyethyl)amine, N,N-dimethylaminoethanol, N,N-diethylaminoethanol, and N,N,N-tris(hydroxymethyl)amine.

Quaternizing Agent

The composition of the present invention contains a quaternizing agent suitable for converting the tertiary amino group to a quaternary nitrogen wherein the quaternizing agent is selected from the group consisting of dialkyl sulfates, benzyl halides, organic carbonates, hydrocarbyl epoxides in combination with an acid or mixtures thereof.

In one embodiment the quaternizing agent can include halides, such as chloride, iodide or bromide; hydroxides; sulfonates; alkyl sulfates, such as dimethyl sulfate; sultones; phosphates; C1-12 alkylphosphates; di C1-12 alkylphosphates; borates; $C_{1-12}$ alkylborates; nitrites; nitrates; carbonates; alkanoates; O,O-di-$C_{1-12}$ alkyldithiophosphates; or mixtures thereof.

In one embodiment the quaternizing agent may be derived from dialkyl sulfates such as dimethyl sulfate, N-oxides, sultones such as propane and butane sultone; alkyl, acyl or araalkyl halides such as methyl and ethyl chloride, bromide or iodide or benzyl chloride, and a hydrocarbyl (or alkyl) substituted carbonates. If the acyl halide is benzyl chloride, the aromatic ring is optionally further substituted with alkyl or alkenyl groups.

The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxide, as represented by the following formula, optionally in combination with an acid:

(IX)

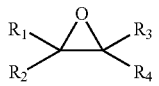

wherein R1, R2, R3 and R4 can be independently H or a $C_{1-50}$ hydrocarbyl group.

Examples of hydrocarbyl epoxides can include, styrene oxide, ethylene oxide, propylene oxide, butylene oxide, stilbene oxide and C2-50 epoxide. Examples of acids can include phenolic acids, such as hydroxybenzoic acid, alkylbenzene sulfonic acid, and carboxylic acids.

The composition of the present invention may also include an optional amount of a succinimide dispersant different from that of component (b). Succinimide dispersants can include quaternary ammonium salts of hydrocarbyl-substituted acylating agent condensation products as described above, or the reaction product of a hydrocarbyl-substituted acylating agent, as described above, and an alkylene polyamine. The alkylene polyamine may be an aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The succinimide dispersant may be derived from an aromatic amine, aromatic polyamine, or mixtures thereof. The aromatic amine may have one or more aromatic moieties linked by a hydrocarbylene group and/or a heteroatom. In certain embodiments, the aromatic amine may be a nitro-substituted aromatic amine. Examples of nitro-substituted aromatic amines include 2-nitroaniline, 3-nitroaniline, and 4-nitroaniline (typically 3-nitroaniline). Other aromatic amines may be present along with the nitroaniline described herein. Condensation products with nitroaniline and optionally also with Disperse Orange 3 (that is, 4-(4-nitrophenylazo)aniline) are known from US Patent Application 2006/0025316.

The succinimide dispersant may be derived from 4-aminodiphenylamine, or mixtures thereof. A succinimide dispersant derived from 4-aminodiphenylamine include those disclosed in International Patent Applications WO2010/062842 or WO2010/099136.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically di ethylene amine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant may be reacted with dimercaptothiadiazoles. In one embodiment the post-treated dispersant may be reacted with phosphoric or phosphorous acid.

It has been found that the use of a succinimide dispersant in addition to a quaternary ammonium salt of a hydrocarbyl-substituted acylating agent condensation product can provide a synergistic dispersant combination as shown in graphs of the dispersants ratings in the coker panel test.

The coker panel test is one measure of dispersant power. Briefly, lubricating compositions are formulated employing a quaternary ammonium salt of a hydrocarbyl-substituted acylating agent condensation product and a succinimide, separately and in combination. The compositions are separately tested by a process of placing a composition in a steel sump at a raised temperature under air. A stirrer consisting of several metal tongs is inserted into the sump and spun at rapid rate of rpm. The apparatus is capped with a flat aluminum plate with a constant surface temperature much higher than the temperature of the composition. The stirring apparatus spins at a rate sufficient to spray a continuous thin layer of the composition onto the aluminum plate for a certain time period. At the end of test, the test plate is removed and rated optically. A percentage universal rating is given the plate with a rating of 0% meaning the plate is completely covered with thick black deposits and a rating of 100% meaning the plate is completely clear of deposits.

Synergy between dispersants can be observed when coker performance of the separate lubricating compositions are graphed on the same graph as a function of the weight fraction of the quaternary ammonium salt of a hydrocarbyl-substituted acylating agent condensation product. The wt fraction of the quaternary ammonium salt of a hydrocarbyl-substituted acylating agent condensation product (z) equals the actives quaternary ammonium salt of a hydrocarbyl-substituted acylating agent condensation product (x) divided by the sum of the actives quaternary ammonium salt of a hydrocarbyl-substituted acylating agent condensation product (x) plus the actives succinimide dispersant (y), or $z=x/(x+y)$. In such graphs, any deviation from linearity demonstrates either a synergy or antagonism.

The succinimide dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition. However, employing the coker panel test, it is well within the level of one of ordinary skill to determine the amount of succinimide dispersant required to create a synergistic dispersant combination with a quaternary ammonium salt of a hydrocarbyl-substituted acylating agent condensation product.

Other Performance Additives

A lubricating composition may be prepared by adding to the product described herein optionally other performance additives (as described herein below). The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants include sulfurized olefins, diarylamines, alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include dispersants beside the optional succinimide dispersant described above, or mixtures thereof. The dispersant may be a Mannich dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulfur containing phenates, sulfur containing phenates, sulfonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, for example, phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent may be employed, the hybrid detergent would be considered equivalent to amounts of distinct phenate and sulfonate detergents introducing like amounts of phenate and sulfonate soaps, respectively.

Typically an overbased metal-containing detergent may be a zinc, sodium, calcium or magnesium phenate, sulfur containing phenate, sulfonate, salixarate or salicylate. Overbased salixarates, phenates and salicylates typically have a total base number of 180 to 450 TBN. Overbased sulfonates typically have a total base number of 250 to 600, or 300 to 500. Overbased detergents are known in the art. In one embodiment the sulfonate detergent may be predominantly a linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The linear alkylbenzene sulfonate detergent may be particularly useful for assisting in improving fuel economy.

Typically the overbased metal-containing detergent may be a calcium or magnesium overbased detergent.

In one embodiment a friction modifier may be included in the formulation, selected from long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22, or 12 to 20 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally may further include at least one antiwear agent. Examples of suitable antiwear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups may be at least 8. The antiwear agent may in one embodiment include a citrate as is disclosed in US Patent Application 20050198894.

Another class of anti-wear additives includes oil-soluble titanium compounds as disclosed in U.S. Pat. No. 7,727,943 and US20060014651. In one embodiment the oil soluble titanium compound may be a titanium (IV) alkoxide. The titanium alkoxide may be formed from a monohydric alcohol, a polyol or mixtures thereof. The monohydric alkoxides may have 2 to 16, or 3 to 10 carbon atoms. In one embodiment, the titanium alkoxide may be titanium (IV) isopropoxide. In one embodiment, the titanium alkoxide may be titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid may be oleic acid.

In one embodiment, the oil soluble titanium compound may be a titanium carboxylate. In one embodiment the titanium (IV) carboxylate may be titanium neodecanoate.

In one embodiment the oil soluble titanium compound may be present in the lubricating composition in an amount necessary to provide for 10 ppm to 1500 ppm titanium by weight or 25 ppm to 150 ppm titanium by weight.

Extreme Pressure (EP) agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptyl-phenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate, and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton37™ (FN 1380) and Exxon Mineral Seal Oil™ (FN 3200).

If the lubricating composition is part of a grease composition, the composition further comprises a thickener. The thickener may include simple metal soap thickeners, soap complexes, non-soap thickeners, metal salts of such acid-functionalized oils, polyurea and diurea thickeners, calcium sulfonate thickeners or mixtures thereof. Thickeners for grease are well known in the art.

INDUSTRIAL APPLICATION

The lubricating composition of the present invention may be useful in an internal combustion engine, a driveline device, a hydraulic system, or a turbine. Likewise, the lubricant composition may be present in a grease or a refrigerant.

In one embodiment the invention provides a method of lubricating an internal combustion engine. The engine components may have a surface of steel or aluminum. An aluminum surface may be derived from an aluminum alloy that may be a eutectic or a hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fueled engine (typically a heavy duty diesel engine), a gasoline fueled engine (typically for passenger cars), a natural gas fueled engine, a mixed gasoline/alcohol fueled engine, or a hydrogen fueled internal combustion engine. In one embodiment the internal combustion engine may be a diesel fueled engine and in another embodiment a gasoline fueled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. In one embodiment the zinc content may be 0.2 wt % or less, or 0.13 wt % or less, or 0.1 wt % or less, or even 0.05% or less. In one embodiment the zinc content may be 0.01 wt % to 0.2 wt %. In one embodiment, the composition may be free of zinc. The total sulfated ash content may be 0.3 wt % to 1.2 wt %, or 0.5 wt % to 1.1 wt % of the lubricating composition. In one embodiment the sulfated ash content may be 0.5 wt % to 1.1 wt % of the lubricating composition.

In one embodiment the lubricating composition may be an engine oil, wherein the lubricating composition may be characterized as having at least one of (i) a sulfur content of 0.5 wt % or less, (ii) a phosphorus content of 0.12 wt % or less, and (iii) a sulfated ash content of 0.5 wt % to 1.1 wt % of the lubricating composition.

In one embodiment the method and lubricating composition of the invention may be suitable for a driveline device. The driveline device includes at least one of gear oils, axle oils, drive shaft oils, traction oils, manual transmission oils, automatic transmission oils, or off highway oils (such as a farm tractor oil). In one embodiment the invention provides a method of lubricating a manual transmission that may or may not contain a synchronizer system. In one embodiment the invention provides a method of lubricating an automatic transmission. In one embodiment the invention provides a method of lubricating an axle.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

Automatic transmissions can contain continuously slipping torque converter clutches (CSTCC), wet start and shifting clutches and in some cases may also include metal or composite synchronizers.

Dual clutch transmissions or automatic transmissions may also incorporate electric motor units to provide a hybrid drive.

A manual transmission lubricant may be used in a manual gearbox which may be unsynchronized or may contain a synchronizer mechanism. The gearbox may be self-contained or may additionally contain any of a transfer gearbox, planetary gear system, differential, limited slip differential or torque vectoring device, which may be lubricated by a manual transmission fluid.

The gear oil or axle oil may be used in planetary hub reduction axles, mechanical steering and transfer gear boxes in utility vehicles, synchromesh gear boxes, power take-off gears, limited slip axles, and planetary hub reduction gear boxes.

The following examples provide illustrations of the invention. These examples are non-exhaustive and are not intended to limit the scope of the invention.

EXAMPLES

Example 1

Preparation of Samples

Sample 1—Salicylic Acid Ammonium Salt of Substituted Succinimide Condensation Product

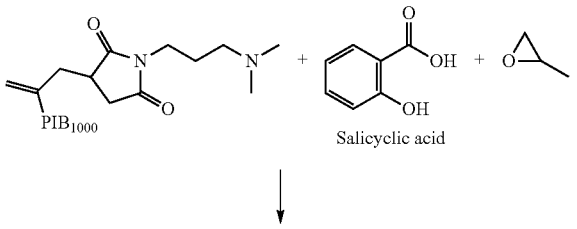

-continued

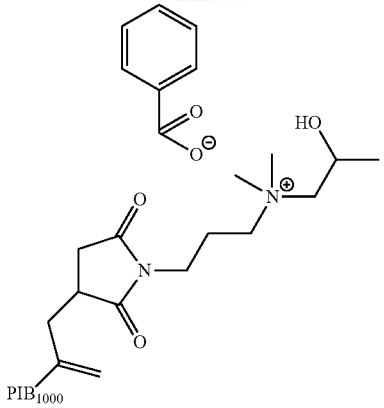

A substituted succinimide condensation product (528.7 g) is placed in a 1 L flask fitted with a thermocouple, nitrogen inlet and condenser. A solution of methanol (219 g) and salicylic acid (72.2 g) is prepared and added to the flask. The mixture is then heated to 55° C. under $N_2$ with stirring (300 rpm). Propylene oxide (56 ml, 46.4 g) is charged to a 50 ml syringe, loaded onto a syringe pump and charged to the reaction subsurface via a needle over 4 hr. The reaction is left stirring overnight. A distillation apparatus is attached and a vacuum is applied. Once sufficient methanol is removed diluent oil (213.3 g) is added to the flask. Vacuum is re-applied and the mixture is slowly heated to 85° C. over 6 hours to complete distillation.

Sample 2—Sulfonic Acid Soap Ammonium Salt of Substituted Succinimide Condensation Product

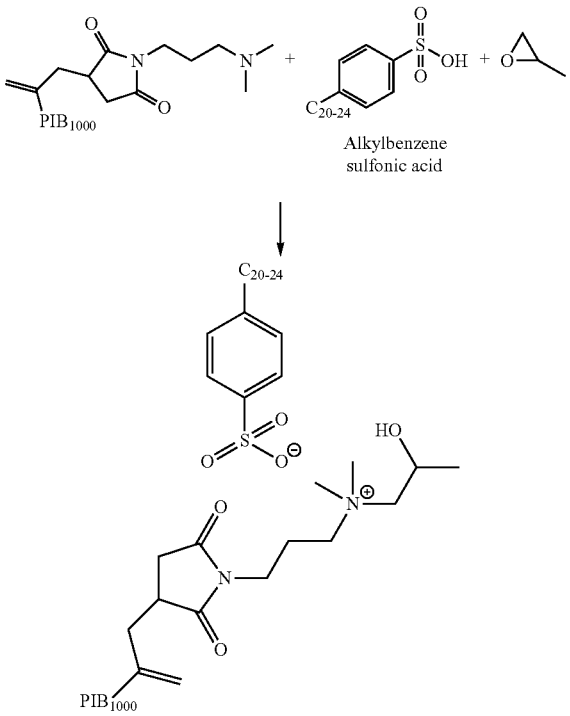

A substituted succinimide condensation product (411.3 g) is placed in a 1 L flask fitted with a thermocouple, nitrogen inlet and condenser. A solution of methanol (170 g) and acetic acid (24.3 g) is prepared and added to the flask. The mixture is then heated to 56° C. under $N_2$ with stirring (230 rpm). Propylene oxide (43 ml, 35.6 g) is charged to a 50 ml syringe, loaded onto a syringe pump and charged to the reaction subsurface via a needle over 4 hr. The reaction mixture is held for 2 hours and left cold for 48 hours. The reaction is then re-heated to 50° C. The intermediate product (553.1 g) is placed in a 2 L flask with alkylbenzene sulfonic acid (206.5 g) and diluent oil (429.7 g). The reaction is then held for 1 hour at 50° C. Distillation apparatus is attached and vacuum applied to remove acetic acid. The temperature is increased to 90° C. over 3 hours. Distillate (70.5 g) is collected. A final aliquot of oil (216.5 g) is added to the flask and the mixture is stirred for 30 minutes at 90° C.

Sample 3—Salicylic Acid Soap Ammonium Salt of Substituted Succinimide Condensation Product

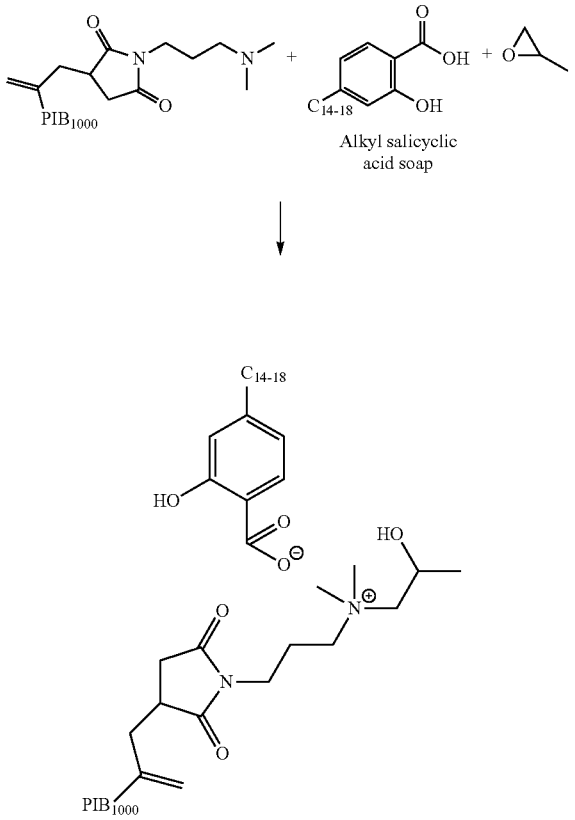

A substituted succinimide condensation product (289.1 g) is placed in a 1 L flask fitted with a thermocouple, nitrogen inlet and condenser. A solution of methanol (117 g) and alkylsalicylic acid soap (72.2 g) is prepared and added to the flask along with diluent oil (140.7 g). The mixture is then heated to 55° C. under $N_2$ with stirring (250 rpm). Propylene oxide (31 ml, 25.7 g) is charged to a 50 ml syringe, loaded onto a syringe pump and charged to the reaction subsurface via a needle over 4 hr. The reaction is left stirring overnight. A distillation apparatus is attached and a vacuum is applied. The mixture is slowly heated to 75° C. over 3 hours to complete distillation.

Sample 4—Ester Salt of Substituted Succinimide Condensation Product

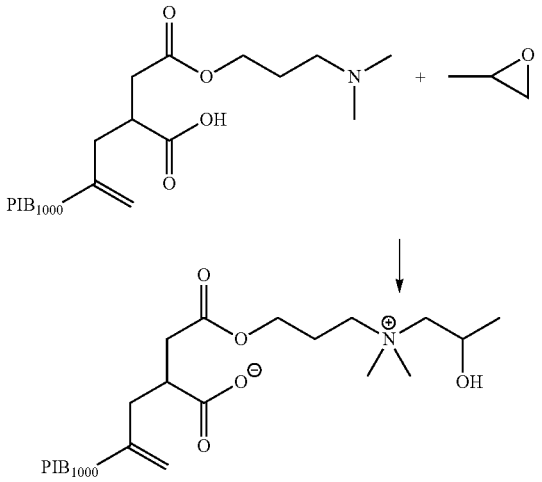

A substituted succinimide condensation product (447.8 g) is placed in a 1 L flask fitted with a thermocouple, nitrogen inlet and condenser, along with methanol (173 g) and with Dil Oil (100 g). The mixture is then heated to 55° C. under $N_2$ with stirring (330 rpm). Propylene oxide (46 ml, 38 g) is charged to a 50 ml syringe, loaded onto a syringe pump and charged to the reaction subsurface via a needle over 4 hr. The reaction is left stirring overnight. The intermediate product (647.0 g) is placed in a 2 L flask with a further aliquot of oil (58.6 g). The reaction is then held for 1 hour at 50° C. Distillation apparatus is attached and vacuum applied. The temperature is increased to 70° C. over 2 hours. A final aliquot of oil (159.3 g) is added to the flask.

Examples 1-7

Coker Testing of Acid Salts of Samples 1, 2 and 3

The acid salts of samples 1, 2 & 3 are formulated into passenger car (PC) engine oil lubricants. Table 1 shows formulas used for coker panel testing. Comparative example 1 is a PC motor oil (5W-30) with standard dispersant/detergent additive package. This baseline lubricant is American Petroleum Institute (API) SM capable. The oil contains 4 wt % (2% actives, i.e., diluent oil free) of a standard PIB succinimide dispersant. In Examples 2 and 3, 100% and 50%, respectively, of the standard succinimide dispersant is replaced with the Sample 1 dispersant at equal actives treat (2 wt % and 1 wt % actives, respectively). In Example 4, the standard succinimide dispersant is left in place and 3 wt % actives treat of Sample 1 is added. The same formulations are created in Examples 5-7, except using Sample 2. Example 8 shows a 3 wt % actives treat of Sample 3 in addition to the standard succinimide dispersant.

The compositions in Table 1 are tested for deposit dispersing performance in the coker panel test. Briefly, 210 g of the composition is placed in a steel sump at a temperature of 105° C. under air. A stirrer having several metal tongs is inserted into the sump and spun at 1000 rpm. The apparatus is capped with a flat aluminum plate with a constant surface temperature of 325° C. The stirring apparatus sprays a continuous thin layer of oil onto the aluminum plate for a period of 4 hours. At the end of test, the test plate is removed and rated optically. A percentage universal rating is given the plate with a rating of 0% meaning the plate is completely covered with thick black deposits and a rating of 100% meaning the plate is completely clear of deposits.

TABLE 1 all values on % actives basis

| | Example # | | | | | | | |
|---|---|---|---|---|---|---|---|---|
| | Comparative Example 1 | 1 | 2 | 3 | 4 | 5 | 6 | 7 |
| Formula | Passenger Car (PC) baseline | PC | PC | PC | PC | PC | PC | PC |
| Vis grade | 5W-30 | 5W-30 | 5W-30 | 5W-30 | 5W-30 | 5W-30 | 5W-30 | 5W-30 |
| Anti-Oxidant | 1.25 | 1.25 | 1.25 | 1.25 | 1.25 | 1.25 | 1.25 | 1.25 |
| Dil oil | 0.26 | 0.26 | 0.26 | 0.26 | 0.26 | 0.26 | 0.26 | 0.26 |
| Detergent | 0.91 | 0.91 | 0.91 | 0.91 | 0.91 | 0.91 | 0.91 | 0.91 |
| Antiwear | 0.79 | 0.79 | 0.79 | 0.79 | 0.79 | 0.79 | 0.79 | 0.79 |
| PIB succinimide dispersant | 2 | — | 1 | 2 | — | 1 | 2 | 2 |
| Sample 1 | — | 2 | 1 | 3 | — | — | — | — |
| Sample 2 | — | — | — | — | 2 | 1 | 3 | — |
| Sample 3 | — | — | — | — | — | — | — | 3 |
| Viscosity Modifier | 0.62 | 0.62 | 0.62 | 0.62 | 0.62 | 0.62 | 0.62 | 0.62 |
| Pour Point Depressant | 0.14 | 0.14 | 0.14 | 0.14 | 0.14 | 0.14 | 0.14 | 0.14 |
| Antifoam | 11 ppm | 11 ppm | 11 ppm | 11 ppm | 11 ppm | 11 ppm | 11 ppm | 11 ppm |
| Coker Rating | 55 | 52 | 75 | 71 | 78 | 79 | 84 | 85 |

Where both Sample 1 and standard succinimide dispersant are present (i.e. where the wt fraction of Sample 1: total dispersant actives is 0.5 as in example 2) the rating is improved relative to Sample 1 or standard succinimide alone. Likewise, where Sample 2 is present in the formula in combination with standard succinimide dispersant (e.g, Example 5) the coker result is slightly better than the formula where Sample 2 only is present (Example 4).

Figure 2:
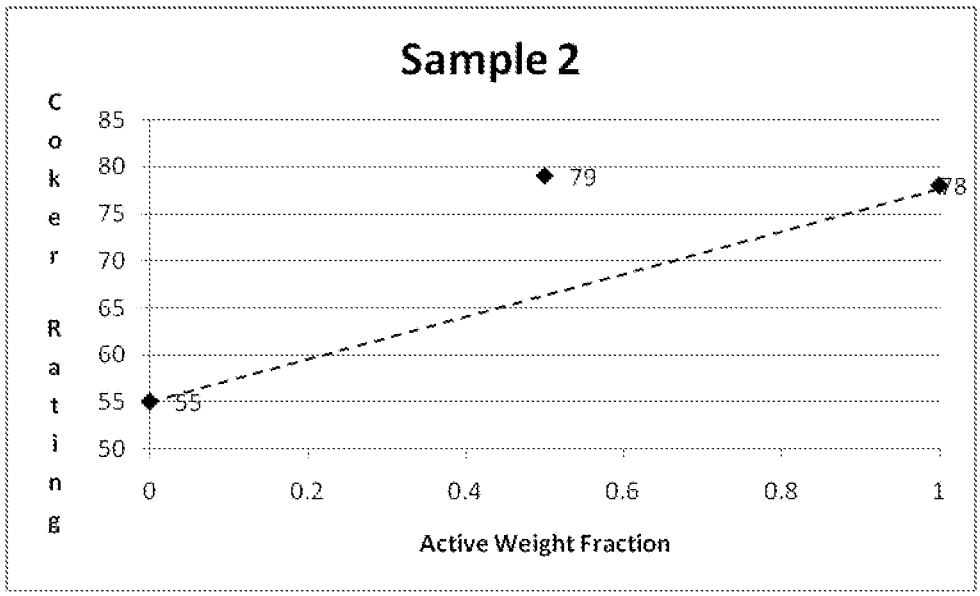
FIG. 2 provides a graphical view of the coker panel results for Sample 2 from Examples 4, 5 and 6.

Such behavior demonstrates deposit dispersion synergy between the two dispersants when results of the tests are graphed. FIG. 1 shows the coker rating vs. active wt. fraction of Sample 1 and FIG. 2 shows the same plot for Sample 2.

For Sample 1, clear improvements are seen at active wt. fractions of 0.5 and 0.6 (relative to 0 and 1), demonstrating a synergy. The same type of synergy is observed with Sample 2. The imide/ammonium salt groups of hydrocarbyl-substituted acylating agent condensation products seem to be affective at breaking up and dispersing deposits, and particularly so when a synergistic amount of another succinimide dispersant is present.

Examples 8

Coker Testing of Ester Salt of Sample 4

The hydrocarbyl-substituted acylating agent condensation product ester salt of Sample 4 is tested in a PC and a heavy duty diesel (HD) formulation. Table 2 shows the PC formulations. Examples 8 and 9 are lubricants where half or all of the standard succinimide dispersant is replaced with Sample 4 at equal actives treat. Example 10 is the same as comparative example 1 except that 3 wt % actives additional ester salt of Sample 4 is top treated.

TABLE 2 all values on % actives basis

| Example # | Comparative Example 1 | 8 | 9 | 10 |
|---|---|---|---|---|
| Formula | Passenger Car (PC) baseline | PC | PC | PC |
| Vis grade | 5W-30 | 5W-30 | 5W-30 | 5W-30 |

TABLE 2-continued all values on % actives basis

| Example # | Comparative Example 1 | 8 | 9 | 10 |
|---|---|---|---|---|
| Anti-Oxidant | 1.25 | 1.25 | 1.25 | 1.25 |
| Dil oil | 0.26 | 0.26 | 0.26 | 0.26 |
| Detergent | 0.91 | 0.91 | 0.91 | 0.91 |
| Antiwear | 0.79 | 0.79 | 0.79 | 0.79 |
| PIB succinimide dispersant | 2 | 1 | — | 2 |
| Sample 4 | — | 1 | 2 | 3 |
| Viscosity Modifier | 0.62 | 0.62 | 0.62 | 0.62 |
| Pour Point Depressant | 0.14 | 0.14 | 0.14 | 0.14 |
| Antifoam | 11 ppm | 11 ppm | 11 ppm | 11 ppm |
| Coker Rating | 55 | 80 | 86 | 83 |

Comparative example 2 is an HD motor oil (15W-40) with a standard dispersant/detergent additive package. The baseline lubricant is API CJ-4 capable. The oil contains 8.2 wt % (4.1 wt % actives) of a standard PIB succinimide dispersant. Examples 11 and 12 are lubricants where half or all of the standard succinimide dispersant is replaced with the ester salt of Sample 4 at equal actives treat.

TABLE 3 all values on % actives basis

| Example # | Comparative Example 2 | 11 | 12 |
|---|---|---|---|
| Formula | Heavy Duty Diesel (HD) Baseline | HD | HD |
| Vis grade | 15W-40 | 15W-40 | 15W-40 |
| Anti-Oxidant | 1.23 | 1.23 | 1.23 |
| Dil oil | 1.03 | 1.03 | 1.03 |
| Detergent | 1.71 | 1.71 | 1.71 |
| Antiwear | 0.99 | 0.99 | 0.99 |
| Corrosion Inhibitor | 0.12 | 0.12 | 0.12 |
| Viscosity Modifier | 1.24 | 1.24 | 1.24 |
| PIB succinimide dispersant | 4.1 | 2.05 | — |

TABLE 3-continued

| all values on % actives basis | | | |
|---|---|---|---|
| Example # | Comparative Example 2 | 11 | 12 |
| Sample 4 | — | 2.05 | 4.1 |
| Pour Point Depressant | 0.08 | 0.08 | 0.08 |
| Antifoam | 100 ppm | 100 ppm | 100 ppm |
| Coker Rating | 46 | 69 | 77 |

Figure 3:
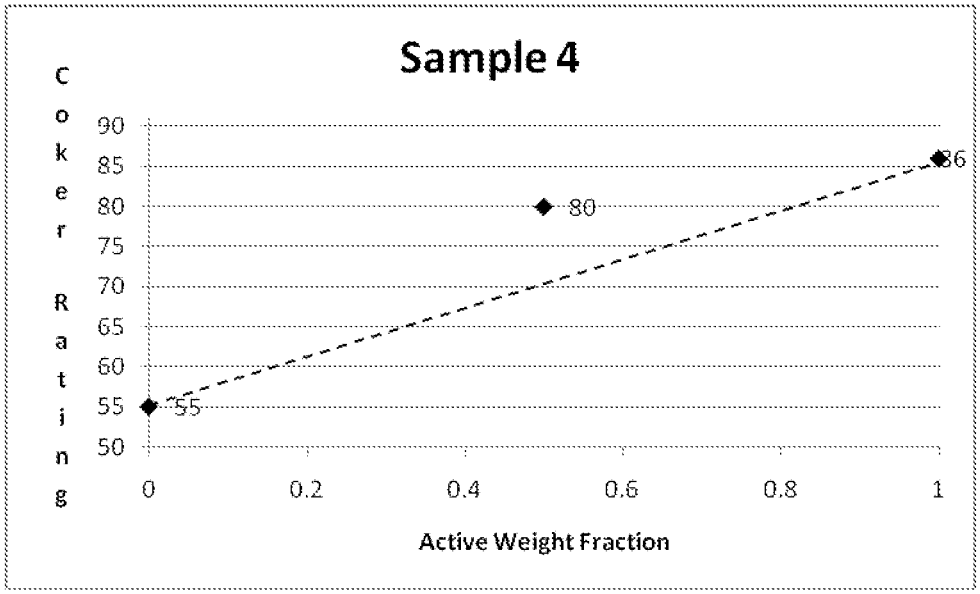
FIG. 3 provides a graphical view of the coker panel results for Sample 4 from Examples 8, 9 and 10.

The compositions in Tables 2 and 3 are tested in the coker panel test, as described above. In both PC and HD formulas, where Sample 4 is present, the coker ratings improve by >20%. While in the HD formulations, the amount of improvement is maximized where the entire allotment of standard dispersant is replaced on equal actives basis with the ester salt of Sample 4, FIG. 3 does show a slight synergy between the dispersants in the PC formulations.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, in the context of this invention, contain other than carbon in a ring or chain otherwise composed of carbon atoms, and encompass substituents as pyridyl, furyl, thienyl and imidazolyl; and (iv) heteroatoms, including sulfur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, (i.e. on an "oil-free" or "active" basis) unless otherwise indicated. It is to be understood that the upper and lower amount, range, and ratio limits set forth herein may be independently combined. Similarly, the ranges and amounts for each element of the invention may be used together with ranges or amounts for any of the other elements. Multiple groups represented by the same symbol in the formulae described above, may be the same or different.

It is known that some of the materials described above may interact in the final formulation, so that the components of the final formulation may be different from those that are initially added. The products formed thereby, including the products formed upon employing lubricating composition of the present invention in its intended use, may not be susceptible of easy description. Nevertheless, all such modifications and reaction products are included within the scope of the present invention; the present invention encompasses lubricating composition prepared by admixing the components described above.

What is claimed is:

1. A composition comprising (a) a major amount of an oil of lubricating viscosity, (b) between 1 to 3 wt % on an oil-free basis of a quaternary ammonium salt comprising the reaction product of: (i) a polyisobutylene succinic anhydride and a compound having an oxygen or nitrogen atom capable of condensing with said polyisobutylene succinic anhydride, and further having a tertiary amino group; and (ii) a quaternizing agent suitable for converting the tertiary amino group to a quaternary nitrogen, wherein the quaternizing agent is selected from the group consisting of (i) organic carbonates; (ii) hydrocarbyl epoxides, (iii) mixtures of hydrocarbyl epoxides and acids, or (iv) mixtures of any of (i)-(iii), and (c) between 1 to 6 wt % on an oil-free basis of a succinimide dispersant comprising the reaction product of a polyisobutylene succinic anhydride and an alkylene polyamine.

2. The composition of claim 1, wherein the compound having an oxygen or nitrogen atom of (i) is $N^1$,$N^1$-dimethylpropane-1,3-diamine or 3-(dimethylamino)propan-1-ol.

3. The composition of claim 1, wherein the compound having an oxygen or nitrogen atom of claim (i) is $N^1$,$N^1$-dimethylpropane-1,3-diamine and the quaternizing agent of (ii) comprises a mixture of propylene oxide and hydroxybenzoic acid.

4. The composition of claim 1, wherein the compound having an oxygen or nitrogen atom of (i) is 3-(dimethylamino)propan-1-ol and the quaternizing agent of (ii) comprises propylene oxide.

5. The composition of claim 1 wherein the alkylene polyamine is $N^1$,$N^1$-dimethylpropane-1,3-diamine.

6. A concentrate suitable for dilution with oil of lubricating viscosity comprising (a) a major amount of an oil of lubricating viscosity, (b) a quaternary ammonium salt derivative comprising the reaction product of: (i) a polyisobutylene succinic anhydride and a compound having an oxygen or nitrogen atom capable of condensing with said polyisobutylene succinic anhydride, and further having a tertiary amino group; and (ii) a quaternizing agent suitable for converting the tertiary amino group to a quaternary nitrogen, wherein the quaternizing agent is selected from the group consisting of (i) organic carbonates; (ii) hydrocarbyl epoxides, (iii) mixtures of hydrocarbyl epoxides and acids, or (iv) mixtures of any of (i)-(iii), and (c a succinimide dispersant comprising the reaction product of a polyisobutylene succinic anhydride and an alkylene polyamine.

7. A method for lubricating a mechanical device comprising supplying thereto a composition according to claim 1.

* * * * *